US009174462B2

(12) United States Patent
Segawa

(10) Patent No.: US 9,174,462 B2
(45) Date of Patent: Nov. 3, 2015

(54) RECORDING APPARATUS

(71) Applicant: SEIKO EPSON CORPORATION, Tokyo (JP)

(72) Inventor: Yuichi Segawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/221,895

(22) Filed: Mar. 21, 2014

(65) Prior Publication Data

US 2014/0292977 A1 Oct. 2, 2014

(30) Foreign Application Priority Data

Mar. 28, 2013 (JP) ..... 2013-069459

(51) Int. Cl.
*B41J 11/053* (2006.01)
*B41J 11/00* (2006.01)
*B41J 13/02* (2006.01)

(52) U.S. Cl.
CPC ..... *B41J 11/0025* (2013.01); *B41J 13/025* (2013.01)

(58) Field of Classification Search
CPC ..... B41J 11/0025; B41J 11/053; B41J 13/025
USPC ..... 347/101, 104; 271/10.11
See application file for complete search history.

(56) References Cited

U.S. PATENT DOCUMENTS

| | | | | |
|---|---|---|---|---|
| 5,829,354 | A * | 11/1998 | Buckley | 101/483 |
| 2008/0088079 | A1* | 4/2008 | Yanagishita | 271/121 |
| 2008/0143035 | A1* | 6/2008 | Ishihara et al. | 271/10.11 |
| 2012/0188318 | A1* | 7/2012 | Yamanobe | 347/102 |

FOREIGN PATENT DOCUMENTS

| | | |
|---|---|---|
| JP | 2005-112490 | 4/2005 |
| JP | 2012-116203 | 6/2012 |
| JP | 2012-121648 | 6/2012 |

* cited by examiner

*Primary Examiner* — Manish S Shah
*Assistant Examiner* — Roger W Pisha, II
(74) *Attorney, Agent, or Firm* — Workman Nydegger

(57) ABSTRACT

A recording apparatus includes: a first roller; a plurality of second rollers which are displaceably provided between a position that is contacted with the first roller and a position that is left apart from the first roller, and are disposed along an axial direction of rotation of the first roller; and a unit that switches roller position, which causes the second rollers located outside a region of a medium among the plurality of second rollers to leave apart from the first roller depending on a size of a medium that is transported.

6 Claims, 10 Drawing Sheets

RECORDING APPARATUS

CROSS REFERENCES TO RELATED APPLICATIONS

The entire disclosure of Japanese Patent Application No. 2013-069459, filed Mar. 28, 2013 is expressly incorporated by reference herein.

BACKGROUND

1. Technical Field

The present invention relates to a recording apparatus represented by a facsimile, a printer or the like.

2. Related Art

In a recording apparatus represented by a facsimile, a printer or the like, a paper transportation unit that accurately transports recording paper fed from a paper feeding section that feeds the recording paper, as an example of a medium, below a recording head may be configured of a driving roller that is rotated by a driving source and a driven roller that is driven to rotate by pressing the recording paper between the driving roller and the driven roller.

Most of the driving rollers are configured by including a high-friction layer on an outer peripheral surface of a shaft body (for example, a metal shaft) and the high-friction layer is formed of wear-resistant particles and a coating material in which the wear-resistant particles are adhered and held on the outer peripheral surface of the shaft body (for example, see JP-A-2012-121648).

Further, when a paper jam occurs in the middle of a transportation path, when the recording paper is interposed between the driving roller and the driven roller, workability is lowered when removing the recording paper. Thus, a configuration that takes into account the workability of the paper removal and releases (separates) the driven roller from the driving roller is adopted in the related art (for example, see JP-A-2005-112490).

Furthermore, if an object to be recorded is a disk-shaped medium, there is a case where a roller mark is caused by the driven roller coming into contact with the disk-shaped medium. Thus, a recording apparatus disclosed in JP-A-2012-116203 includes a configuration in which each of positions of a plurality of driven rollers is displaced in a contact and separation direction with respect to the driving roller.

The recording apparatus disclosed in JP-A-2012-121648 is made by considering convenience of paper jam recovery work and the recording apparatus disclosed in JP-A-2005-112490 is made by considering the transportation of the disk-shaped medium, however they still have problems as described below.

That is, when recording on the recording paper such as plain paper, a plurality of driven rollers are driven to rotate by coming into contact with the paper and some driving rollers located outside a paper region are driven to rotate by directly coming into contact with the driving roller. However, since the driven rollers of the latter come into contact with the driving roller having the high-friction layer on the outer peripheral surface thereof, that is, the driving roller having a great number of fine unevenness on the outer peripheral surface thereof, as a result, a harsh noise may occur.

Particularly, if the size of the paper is small, since the number of the driven rollers or the contact region coming into contact with the driving roller increases, the degree of the noise becomes more remarkable. Therefore, in recent years, in ink jet printers, noise reduction is further required and it is preferable that occurrence of noise, as described above, be effectively suppressed.

SUMMARY

An advantage of some aspects of the invention is to provide a recording apparatus which is more suited for noise reduction.

According to an aspect of the invention, there is provided a recording apparatus including: a first roller; a plurality of second rollers which are displaceably provided between a position that is urged to a side of the first roller and a position that is left apart from the first roller, and are disposed along an axial direction of rotation of the first roller; and a unit that switches roller positioning, which causes the second rollers located outside a region of a medium among the plurality of second rollers to leave apart from the first roller.

In this case, since the unit that switches roller positioning, which causes the second rollers located outside the region of the medium among the plurality of second rollers to leave apart from the first roller is provided, it is possible to suppress occurrence of noise caused by the second rollers coming into contact with the first roller and obtain the recording apparatus with reduced noise.

In addition, it is possible to prevent wear of the second rollers and the first roller, and improve durability of the apparatus by the second roller located outside the region of the medium leaving apart from the first roller.

In a second aspect according to the first aspect, the unit that switches roller position may cause the second rollers located outside the region of the medium among the plurality of second rollers to leave apart from the first roller depending on a width of the medium that is transported.

In this case, since the unit that switches roller position causes the second rollers located outside the region of the medium among the plurality of second rollers to leave apart from the first roller depending on the width of the medium that is transported, it is possible to effectively suppress occurrence of noise caused by the second rollers coming into contact with the first roller.

In a third aspect according to the first or second aspect, the unit that switches roller position may cause the second rollers associated with the region of the medium to leave apart from the first roller for at least a predetermined period until a leading end of the medium of the next page reaches between the first roller and the second rollers after a trailing end of the medium of the preceding page is removed between the first roller and the second rollers when recording is performed on a plurality of pages.

In this case, since the unit that switches roller position also causes the second rollers associated with the region of the medium to leave apart from the first roller for at least a predetermined period while it does not contribute to the transportation of the medium during recording, it is possible to reliably prevent occurrence of the noise caused by the second rollers coming into contact with the first roller.

In a fourth aspect according to any one of the first to third aspects, the recording apparatus may further include: a plurality of support members which are provided along the axial direction of the rotation of the first roller and includes at least one driven roller that switches a posture which causes the second rollers to urge to the side of the first roller and a posture which causes the second rollers to leave apart from the first roller by oscillating. The unit that switches roller position may include rotatable cam members which are provided with respect to the plurality of support members, individually, and engage the support members in positions away from an oscillation center of the support members, and a cam driving source that rotates the cam members. The cam driving source may rotate the cam member so that the support members may perform the switching of the posture.

In this case, since the second rollers are displaced by the rotation of the cams, it is possible to configure the unit that switches the roller with a simple structure and at a low cost.

In a fifth aspect according to the fourth aspect, a plurality of cam members may be provided in one rotation shaft that is driven to rotate by the cam driving source and at least one of shapes and mounting forms of the plurality of cam members with respect to the one rotation shaft may be different from each other, and the support members may take a posture depending on sizes of a plurality of media in a range of one rotation of the one rotation shaft.

In this case, since each of the plurality of support members takes the posture depending on the sizes of the plurality of types of media by the rotation of one rotation shaft, it is possible to obtain the configuration of the support members taking the posture depending on the sizes of the plurality of types of media easily and at a low cost.

In a sixth aspect according to any one of the first to fifth aspects, the unit that switches roller position may cause all of the second rollers to leave apart from the first roller at least when the recording is not performed.

In this case, since the unit that switches roller position causes all of the second rollers to leave apart from the first roller at least when the recording is not performed, it is possible to more reliably prevent occurrence of the noise caused by the second rollers coming into contact with the first roller.

In a seventh aspect according to any one of the first to sixth aspects, the first roller may be formed by attaching particles on an outer peripheral surface of a metal shaft.

In this case, since the first roller is formed by attaching particles on the outer peripheral surface of the metal shaft, the noise described above is likely to occur by the second rollers coming into contact with the first roller, but it is possible to suppress the occurrence of the noise by the operation of the first aspect to the fifth aspect.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
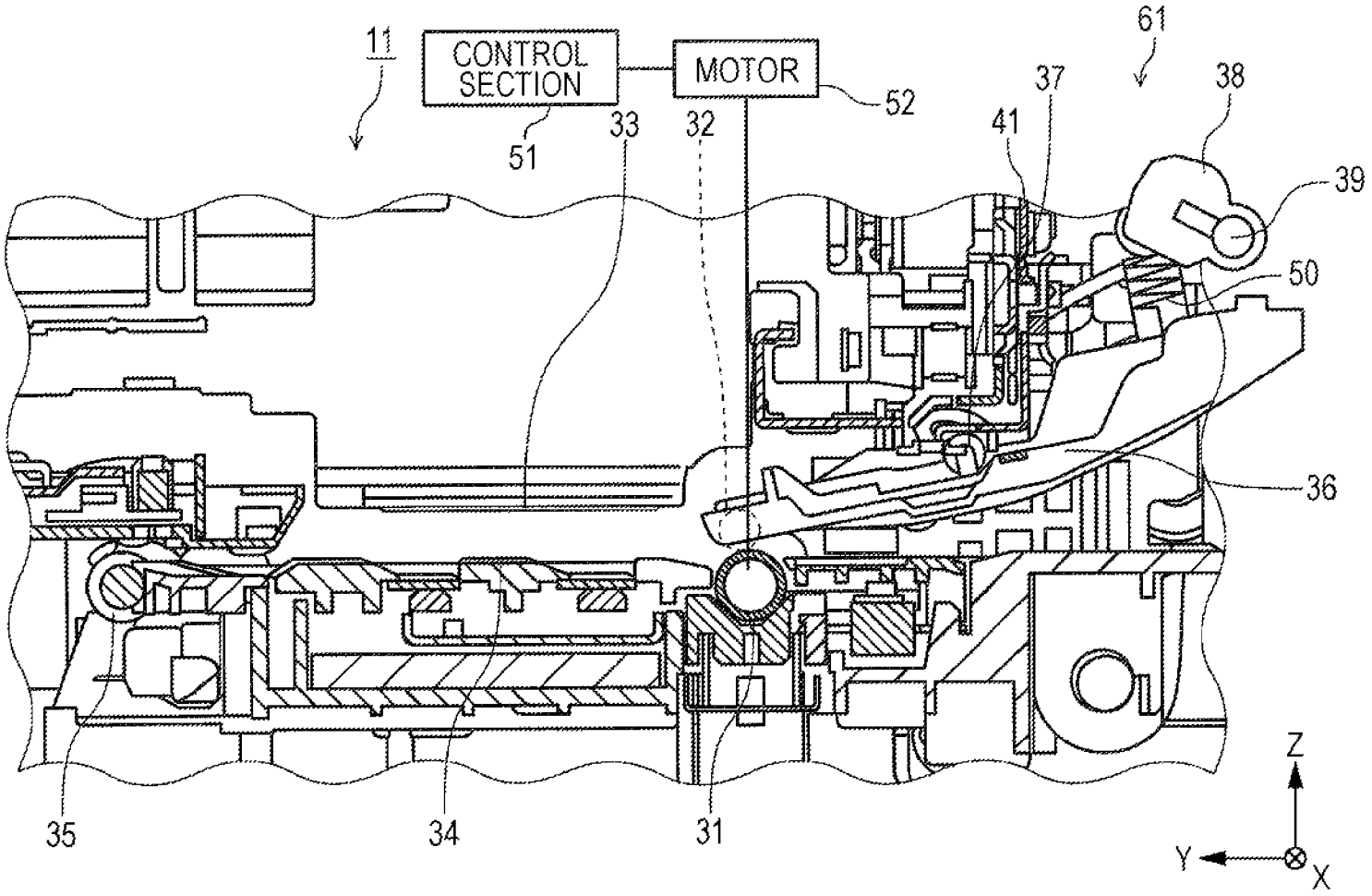
FIG. 1 is a cross-sectional view illustrating an internal configuration of a printer according to the invention.

Hereinafter, an embodiment of the invention is described with reference to the drawings. FIG. 1 is a cross-sectional view illustrating an internal configuration of a printer 11 according to the embodiment of the invention.

Moreover, a longitudinal direction is illustrated by a Y axis, a vertical direction is illustrated by a Z axis and a lateral direction is illustrated by an X axis with respect to the printer 11. Further, hereinafter, a front side of the X axis direction in FIG. 1 simply refers to a right side, a back side of the X axis direction in FIG. 1 simply refers to a left side. Further, hereinafter, a left side of the Y axis direction in FIG. 1 simply refers to a front side and a right side of the Y axis direction in FIG. 1 simply refers to the back side. Further, hereinafter, an upper side of the Z axis direction in FIG. 1 simply refers to the upper side and a lower side of the Z axis direction in FIG. 1 simply refers to the lower side.

That is, FIG. 1 is a cross-sectional view illustrating a cross section of the inside of the printer 11 in a plane parallel to a plane defined by the Z axis and the Y axis. The printer 11 according to the embodiment is an ink jet printer that is an example of a recording apparatus that performs recording on paper as an example of a medium. The printer 11 includes a roller 31, rollers 32, a recording head 33, a paper support section 34 and a roller 35.

Each configuration portion of the printer 11 is supported on a base frame 41 that is a structure which is a frame of the printer 11. The roller 31 is cylindrically formed of metal. That is, the roller 31 is a hollow shaft. Since the roller 31 is the hollow shaft, it is possible to reduce the weight of the roller 31, that is, it is possible to reduce the weight of the printer 11 as a whole. A high-friction layer 91 (FIG. 3) that is formed by wear-resistant particles and coating material that bonds and holds the wear-resistant particles on an outer peripheral surface of the roller 31 is formed on an outer peripheral surface of outer peripheral surfaces of the roller 31, which comes into contact with the paper that is transported. That is, the roller 31 is formed by attaching particles on the outer peripheral surface of the metal shaft. When the paper is transported forward (a direction of a downstream side of a paper transportation path: the same applies hereinafter), the roller 31 is rotated in a counter-clockwise direction about an axis of the X axis direction in FIG. 1 by a motor 52.

The roller 32 is formed of a thermoplastic resin such as polyoxymethylene (POM). That is, the roller 32 is formed of a resin material. A plurality of the rollers 32 are provided along the axial direction of the rotation of the roller 31 in the printer 11. The roller 32 is disposed on the upper side of the roller 31 and is displaceably provided between a position coming into contact with the roller 31 and a position leaving apart from the roller 31. The roller 32 is displaced to the position in contact with the roller 31 and is pressed downward against the roller 31 when the paper to be recorded passes a lower side of the roller 32. The roller 32 is displaced to the position left apart from the roller 31 when the paper to be recorded is removed from the lower side of the roller 32 or when the recording is not performed (described below in detail).

When the roller 32 is displaced to the position in contact with the roller 31 and then the paper is transported forward, the roller 32 is rotated in the clockwise direction around the axial direction in the Y axis direction by the roller 31 in FIG.

1. In this case, the roller 31 and the roller 32 insert the paper therebetween and transport the paper forward.

The paper inserted between the roller 31 and the roller 32 is transported forward in the transportation path illustrated by an arrow CA in FIG. 1. The recording head 33 is provided on an upper side of the transportation path and the paper support section 34 is provided on the lower side thereof. That is, the paper inserted between the roller 31 and the roller 32 is transported forward in the transportation path between the recording head 33 and the paper support section 34. The recording head 33 performs the recording on the paper by ejecting ink on the paper that is supported on the paper support section 34. The paper support section 34 is provided in a position facing the recording head 33 and keeps a distance between the paper and the recording head 33 in a predetermined length.

The roller 35 is formed of an elastic material such as rubber. When paper is recorded by the recording head 33, the roller 35 is rotated in the counter-clockwise direction around the axis in the Y axis direction by the motor 52 in FIG. 1. The roller 35 transports the paper on which the recording is performed by the recording head 33 forward, and discharges the paper from the printer 11.

The roller 32 is rotatably supported on an end section of a front side of a support member 36. As described below with reference to FIG. 2, a plurality of support members 36 are provided along the axial direction of the rotation of the roller 31 in the printer 11. The support member 36 causes the roller 32 to adopt a posture (a posture in which the roller 32 is urged to the roller 31) for urging to the side of the roller 31 and the roller 32 to adopt a posture for leaving apart from the roller 31 by oscillating. At least one of the rollers 32 is provided in the support member 36.

A shaft support section 37 that pivotally supports the support member 36 is provided substantially on a center of each of the plurality of support members 36 in the longitudinal direction. At least one of the shaft support sections 37 is provided in each of the plurality of support members 36. An end of a coil spring 50 is fixed to a back side of the support member 36, that is, a back side of a portion in which the shaft support section 37 is provided. The other end of the coil spring 50 is fixed to the base frame 41. The coil spring 50 exerts an upward force on the back side of the support member 36. Further, a portion of the base frame 41 on which the coil spring 50 is mounted is not illustrated in FIG. 1. Further, the base frame 41 also pivotally supports the support member 36.

A contact surface 71 coming into contact with the outer periphery of a cam 38 is provided on the end section of the back side of the support member 36. The cam 38 is provided with respect to the plurality of support members 36, individually and engages the support member 36 in a position away from an oscillation center of the support member 36. The cam 38 is rotatable with respect to the base frame 41.

More particularly, the cam 38 is a so-called disk cam. A plurality of cams 38 are provided so as to oscillate the plurality of support members 36, respectively. The cam 38 is rotated in the clockwise direction or the counter-clockwise direction around the axis in the Y axis direction through a rotation shaft 39 in FIG. 1 by the motor 52. The cam 38 has a shape of which a length from a rotation center to an outer periphery thereof is different depending on a rotation angle. The outer periphery of the cam 38 is left apart from the contact surface 71 that is provided in the end section of the back side of the support member 36 or pushes down the contact surface 71 depending on the rotation angle. The plurality of cams 38 are fixed to one rotation shaft 39 that is rotated by the motor 52. The rotation shaft 39 is rotatably provided in the base frame 41.

A control section 51 includes a dedicated or programmable Integrated Circuit (IC), a Micro Processing Unit (MPU) executing a control program or the like and controls each section of the printer 11. The control section 51 controls the rotational drive of the motor 52 that drives the roller 31, the roller 35, the cam 38 or the like.

The motor 52 rotates the roller 31, the roller 35, the cam 38 or the like. As described below in detail, the motor 52 rotates the cam 38 so that the support member 36 performs switching of the posture. Moreover, a roller position switching section 61 includes the cam 38, the rotation shaft 39 and the motor 52. The roller position switching section 61 causes the roller 32 which is outside a region of the paper among a plurality of rollers 32 to leave apart from the roller 31 depending on a size of the paper that is transported. Here, the size of the paper refers to a dimension of the paper such as A3, A4 or A5 included in an A column that is the international standard defined in the International Organization for Standardization (ISO) 216 or a postcard or the like that is a second-class mail.

Figure 2:
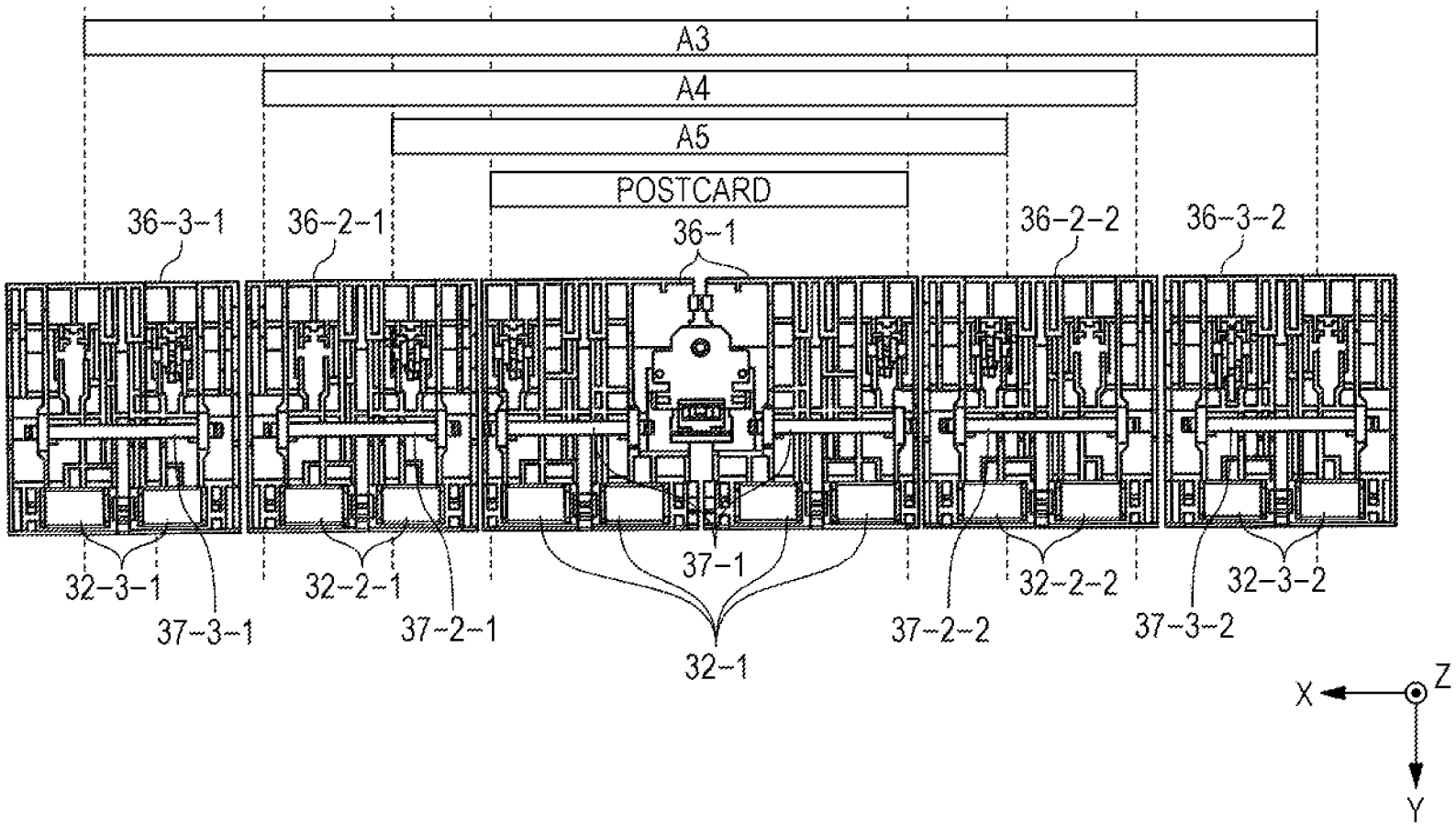
FIG. 2 is a top view of rollers, support members, and shaft support sections.

Next, the plurality of rollers 32, the plurality of support members 36 and the plurality of shaft support sections 37 which are provided depending on the size of the paper, A3, A4 or A5 or the postcard are described with reference to FIG. 2. FIG. 2 is a top view of the plurality of rollers 32, the plurality of support members 36 and the plurality of shaft support sections 37.

Hereinafter, if it is necessary to distinguish each of the plurality of support members 36, each of the plurality of support members 36 refers to a support member 36-1, a support member 36-2-1, a support member 36-2-2, a support member 36-3-1 or a support member 36-3-2, individually. Further, hereinafter, if it is necessary to distinguish each of the plurality of rollers 32, each of the plurality of rollers 32 refers to a roller 32-1, a roller 32-2-1, a roller 32-2-2, a roller 32-3-1 or a roller 32-3-2, for each of the rollers 32 that is provided in the support member 36-1, the support member 36-2-1, the support member 36-2-2, the support member 36-3-1 or the support member 36-3-2, individually. Further, hereinafter, if it is necessary to distinguish each of the plurality of shaft support sections 37, each of the plurality of shaft support sections 37 refers to a shaft support section 37-1, a shaft support section 37-2-1, a shaft support section 37-2-2, a shaft support section 37-3-1 or a shaft support section 37-3-2, individually.

Two support members 36-1, the support member 36-2-1, the support member 36-2-2, the support member 36-3-1 and the support member 36-3-2 are disposed along the axial direction of the rotation of the roller 31. That is, the support members 36-1, the support member 36-2-1, the support member 36-2-2, the support member 36-3-1 and the support member 36-3-2 are disposed to be aligned in the X axis direction.

Two support members 36-1 are disposed across the center of the transportation path transporting the paper in the X axis direction. A width of the two support members 36-1, that is, a length in the X axis direction is slightly longer than 100 mm that is a length of a short side of the postcard. Two rollers 32-1 are relatively supported in the end section of the front side of the support member 36-1. The support member 36-1 is pivotally supported by the shaft support section 37-1 so as to be capable of vertically displacing the rollers 32-1.

The support member 36-2-1 is disposed on a left side of the support member 36-1. A width of the support member 36-2-1, that is, a length in the X axis direction is a length substantially the same as half a value obtained by subtracting 100 mm that is the width of the postcard from 210 mm that is a width of A4 paper. Two rollers 32-2-1 are rotatably supported in the end section of the front side of the support member 36-2-1. The support member 36-2-1 is pivotally supported by the shaft support section 37-2-1 so as to be capable of vertically displacing the roller 32-2-1.

The support member 36-2-2 is disposed on a right side of the support member 36-1. A width of the support member 36-2-2, that is, a length in the X axis direction is a length substantially the same as the width of the support member 36-2-1. Two rollers 32-2-2 are rotatably supported in the end section of the front side of the support member 36-2-2. The support member 36-2-2 is pivotally supported by the shaft support section 37-2-2 so as to be capable of vertically displacing the roller 32-2-2.

The support member 36-3-1 is disposed on the left side of the support member 36-2-1. A width of the support member 36-3-1, that is, a length in the X axis direction is a length substantially the same as the width of the support member 36-2-1. Two rollers 32-3-1 are rotatably supported in the end section of the front side of the support member 36-3-1. The support member 36-3-1 is pivotally supported by the shaft support section 37-3-1 so as to be capable of vertically displacing the roller 32-3-1.

The support member 36-3-2 is disposed on a right side of the support member 36-2-2. A width of the support member 36-3-2, that is, a length in the X axis direction is a length substantially the same as the width of the support member 36-3-1. Two rollers 32-3-2 are rotatably supported in the end section of the front side of the support member 36-3-2. The support member 36-3-2 is pivotally supported by the shaft support section 37-3-2 so as to be capable of vertically displacing the roller 32-3-2.

When the paper as the postcard is transported and recorded, the paper as the postcard is transported to the lower side of the support member 36-1. When the paper as the postcard is transported and recorded, the support member 36-1 causes the roller 32-1 to adopt a posture for urging to the side of the roller 31, the support member 36-2-1 causes the roller 32-2-1 to adopt a posture for leaving apart from the roller 31, the support member 36-2-2 causes the roller 32-2-2 to adopt a posture for leaving apart from the roller 31, the support member 36-3-1 causes the roller 32-3-1 to adopt a posture for leaving apart from the roller 31, and the support member 36-3-2 causes the roller 32-3-2 to adopt a posture for leaving apart from the roller 31.

When the paper as the postcard is transported and recorded, the roller 32-1 (the roller 32-1 of a left end) on the side of the support member 36-2-1 among four rollers 32-1 provided in the support members 36-1 is disposed in a position coming into contact with an end section of the left side in the width direction intersecting the transportation direction among end sections of the paper as the postcard. When the paper as the postcard is transported and recorded, the roller 32-1 (the roller 32-1 of a right end) on the side of the support member 36-2-2 among four rollers 32-1 provided in the support members 36-1 is disposed in a position coming into contact with an end section of the right side in the width direction intersecting the transportation direction among end sections of the paper as the postcard. That is, the roller 32-1 of the left end and the roller 32-1 of the right end provided in the support member 36-1 are disposed in positions coming into contact with both ends of the paper of postcard in the width direction intersecting transportation direction, respectively.

When the paper of A5 is transported and recorded, the paper of A5 is transported to the lower side of the support member 36-1, the support member 36-2-1 and the support member 36-2-2. In this case, the end section of the left side in the width direction intersecting the transportation direction among the end sections of the paper of A5 is transported to the lower side of a slightly right side from the center of the support member 36-2-1 in the X axis direction, and the end section of the right side in the width direction intersecting the transportation direction among the end sections of the paper of A5 is transported to the lower side of a slightly left side from the center of the support member 36-2-2 in the X axis direction.

When the paper of A5 is transported and recorded, the support member 36-1 causes the roller 32-1 to adopt a posture for urging to the side of the roller 31, the support member 36-2-1 causes the roller 32-2-1 to adopt a posture for urging to the side of the roller 31, the support member 36-2-2 causes the roller 32-2-2 to adopt a posture for urging to the side of the roller 31, the support member 36-3-1 causes the roller 32-3-1 to adopt a posture for leaving apart from the roller 31, and the support member 36-3-2 causes the roller 32-3-2 to adopt a posture for leaving apart from the roller 31.

When the paper of A5 is transported and recorded, the roller 32-2-1 (the roller 32-2-1 of the right side) on the side of the support member 36-1 among the rollers 32-2-1 provided in the support member 36-2-1 is disposed in a position coming into contact with an end section of the left side in the width direction intersecting the transportation direction among end sections of the paper of A5. In addition, when the paper of A5 is transported and recorded, the roller 32-2-2 (the roller 32-2-2 of the left side) on the side of the support member 36-1 among the rollers 32-2-2 provided in the support member 36-2-2 is disposed in a position coming into contact with an end section of the right side in the width direction intersecting the transportation direction among end sections of the paper of A5.

That is, the roller 32-2-1 of the right side provided in the support member 36-2-1 and the roller 32-2-2 of the left side provided in the support member 36-2-2 are disposed in positions coming into contact with both ends of the paper of A5 in the width direction intersecting transportation direction, respectively.

When the paper of A4 is transported and recorded, the paper of A4 is transported to the lower side of the support member 36-1, the support member 36-2-1 and the support member 36-2-2. When the paper of A4 is transported and recorded, the support member 36-1 causes the roller 32-1 to adopt a posture for urging to the side of the roller 31, the support member 36-2-1 causes the roller 32-2-1 to adopt a posture for urging to the side of the roller 31, the support member 36-2-2 causes the roller 32-2-2 to adopt a posture for urging to the side of the roller 31, the support member 36-3-1 causes the roller 32-3-1 to adopt a posture for leaving apart from the roller 31, and the support member 36-3-2 causes the roller 32-3-2 to adopt a posture for leaving apart from the roller 31.

When the paper of A4 is transported and recorded, the roller 32-2-1 (the roller 32-2-1 of the left side) on the side of the support member 36-3-1 among the rollers 32-2-1 provided in the support member 36-2-1 is disposed in a position coming into contact with an end section of the left side in the width direction intersecting the transportation direction among end sections of the paper of A4. In addition, when the paper of A4 is transported and recorded, the roller 32-2-2 (the roller 32-2-2 of the right side) on the side of the support member 36-3-2 among the rollers 32-2-2 provided in the support member 36-2-2 is disposed in a position coming into contact with an end section of the right side in the width direction intersecting the transportation direction among end sections of the paper of A4.

That is, the roller 32-2-1 of the left side provided in the support member 36-2-1 and the roller 32-2-2 of the right side provided in the support member 36-2-2 are disposed in positions coming into contact with both ends of the paper of A4 in the width direction intersecting transportation direction, respectively.

When the paper of A3 is transported and recorded, the paper of A3 is transported to the lower side of the support member 36-1, the support member 36-2-1, the support member 36-2-2, the support member 36-3-1 and the support member 36-3-2. When the paper of A3 is transported and recorded, the support member 36-1 causes the roller 32-1 to adopt a posture for urging to the side of the roller 31, the support member 36-2-1 causes the roller 32-2-1 to adopt a posture for urging to the side of the roller 31, the support member 36-2-2 causes the roller 32-2-2 to adopt a posture for urging to the side of the roller 31, the support member 36-3-1 causes the roller 32-3-1 to adopt a posture for urging to the roller 31, and the support member 36-3-2 causes the roller 32-3-2 to adopt a posture for urging to the side of the roller 31.

When the paper of A3 is transported and recorded, the roller 32-3-1 on the left side among the rollers 32-3-1 provided in the support member 36-3-1 is disposed in a position coming into contact with an end section of the left side in the width direction intersecting the transportation direction among end sections of the paper of A3. In addition, when the paper of A3 is transported and recorded, the roller 32-3-2 on the right side among the rollers 32-3-2 provided in the support member 36-3-2 is disposed in a position coming into contact with an end section of the right side in the width direction intersecting the transportation direction among end sections of the paper of A3.

That is, the roller 32-3-1 of the left side provided in the support member 36-3-1 and the roller 32-3-2 of the right side provided in the support member 36-3-2 are disposed in positions coming into contact with both ends of the paper of A3 in the width direction intersecting transportation direction, respectively.

As described above, the roller 32 located outside the region of the paper among the plurality of rollers 32 is left apart from the roller 31 depending on the size of the paper that is transported.

Further, the plurality of rollers 32 are disposed in the positions coming into contact with the both ends of all sizes of a plurality of papers in the width direction intersecting the transportation direction.

Next, a case where the paper of each size is transported and recorded, and a case where the recording is not performed are described in detail with reference to FIGS. 3 to 9 and 10A to 10C. Hereinafter, if it is necessary to distinguish each of the plurality of cams 38, each of the plurality of cams 38 refers to a cam 38-1, a cam 38-2-1, a cam 38-2-2, a cam 38-3-1, or a cam 38-3-2, individually. Hereinafter, if it is necessary to distinguish each of the contact surfaces 71 provided in each of the support member 36-1, the support member 36-2-1 and the support member 36-3-1, each of the contact surfaces 71 refers to a contact surface 71-1, a contact surface 71-2-1 and a contact surface 71-3-1, individually.

FIGS. 3, 5, 7 and 9 are perspective views of the support member 36-1, the support member 36-2-1, the support member 36-2-2, the support member 36-3-1 and the support member 36-3-2, and cam 38-1, the cam 38-2-1, the cam 38-2-2, the cam 38-3-1 or the cam 38-3-2, respectively. FIGS. 4A to 4C, 6A to 6C, 8A to 8C and 10A to 10C are side views of the support member 36-1, the support member 36-2-1 and the support member 36-3-1, and cam 38-1, the cam 38-2-1 and the cam 38-3-1, respectively.

FIGS. 3 and 4A to 4C are views illustrating a state where the paper of A3 is transported and recorded. FIGS. 5 and 6A to 6C are views illustrating a state where the paper of A4 or A5 is transported and recorded. FIGS. 7 and 8A to 8C are views illustrating a state where the paper as the postcard is transported and recorded. FIGS. 9 and 10A to 10C are views illustrating from a state where a leading end of the paper of the next page reaches between the roller 31 and the roller 32 after a trailing end of the paper of the preceding page is removed between the roller 31 and the roller 32 when recording is performed on a plurality of pages or a state where the recording is not performed.

Figure 3:
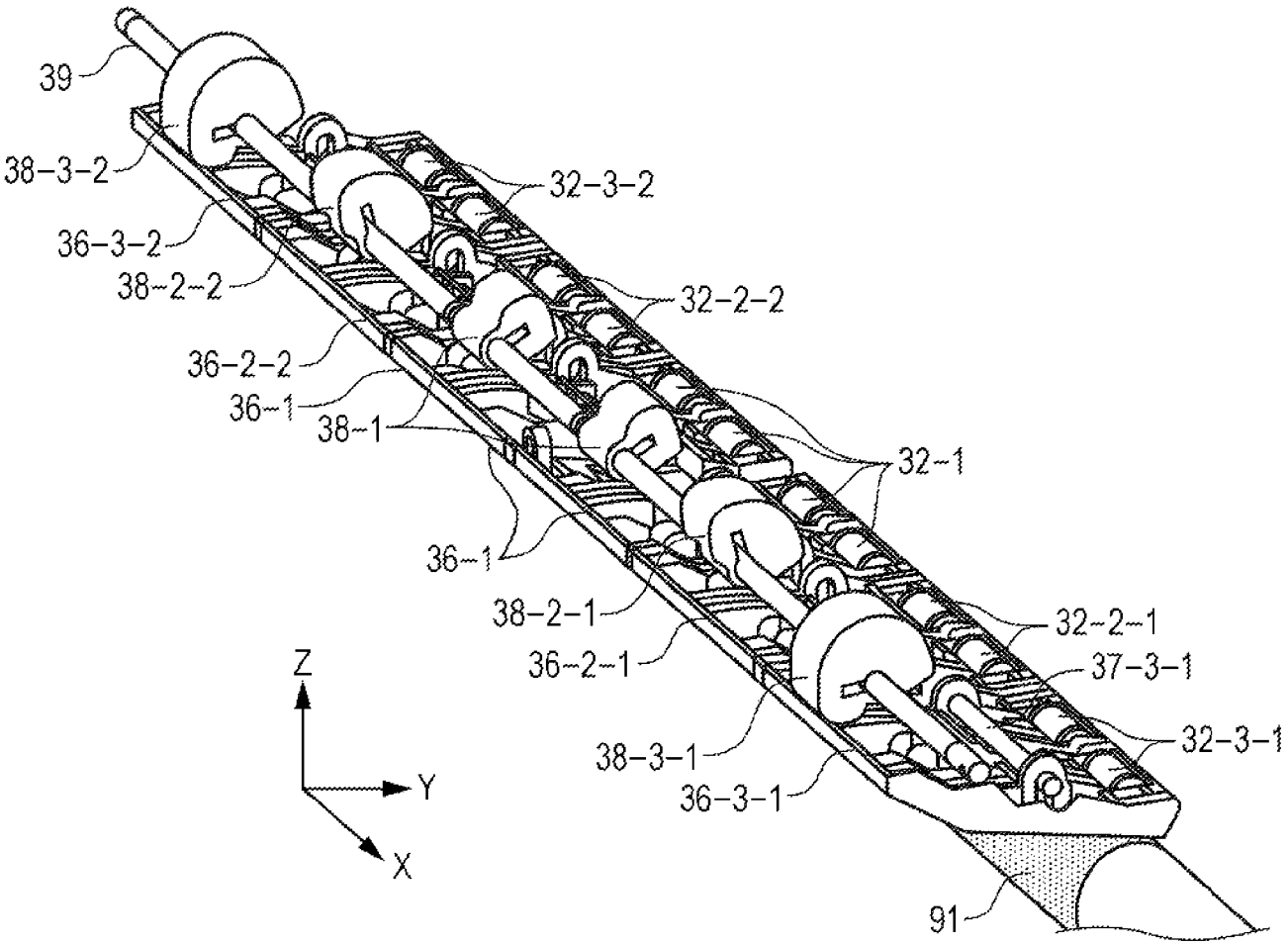
FIG. 3 is a perspective view of support members and cams.

First, when the paper of A3 is transported and recorded, the support member 36-1, the support member 36-2-1, the support member 36-2-2, the support member 36-3-1 and the support member 36-3-2, and cam 38-1, the cam 38-2-1, the cam 38-2-2, the cam 38-3-1 or the cam 38-3-2 are described with reference to FIGS. 3 and 4A to 4C. When the paper of A3 is transported and recorded, the control section 51 controls the motor 52 and rotates the rotation shaft 39. Then, as illustrated in FIG. 3, angular positions of the cam 38-1, the cam 38-2-1, the cam 38-2-2, the cam 38-3-1 and the cam 38-3-2 provided in the rotation shaft 39 are predetermined angular positions of a case where the paper of A3 is transported and recorded.

Figure 4A:
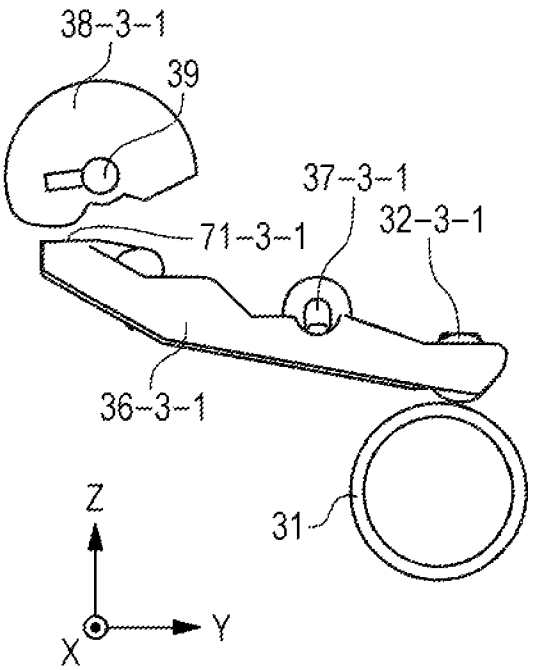
FIGS. 4A to 4C are side views of the support members and the cams.

As illustrated in FIG. 4A, the outer periphery of the cam 38-3-1 leaves apart from the contact surface 71-3-1 provided in the support member 36-3-1. In this case, since the back side of the support member 36-3-1, that is, the back side of a portion in which the shaft support section 37-3-1 is provided is pulled up by the coil spring 50, a downward force is applied to the end section of the front side of the support member 36-3-1. The support member 36-3-1 is oscillated around the shaft support section 37-3-1 in the clockwise direction in FIG. 4A. Since the end section of the front side of the support member 36-3-1 moves to the lower side, the roller 32-3-1 is pressed against the roller 31.

In this case, the support member 36-3-2 is operated similar to the support member 36-3-1 and the roller 32-3-2 is pressed against the roller 31.

Figure 4B:
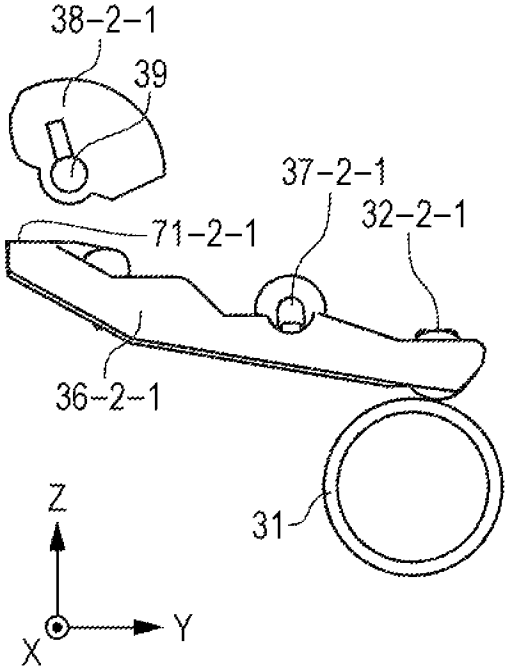

As illustrated in FIG. 4B, the outer periphery of the cam 38-2-1 leaves apart from the contact surface 71-2-1 provided in the support member 36-2-1. In this case, since the back side of the support member 36-2-1, that is, the back side of a portion in which the shaft support section 37-2-1 is provided is pulled up by the coil spring 50, the downward force is applied to the end section of the front side of the support member 36-2-1. The support member 36-2-1 is oscillated around the shaft support section 37-2-1 in the clockwise direction in FIG. 4B. Since the end section of the front side of the support member 36-2-1 moves to the lower side, the roller 32-2-1 is pressed against the roller 31.

In this case, the support member 36-2-2 is operated similar to the support member 36-2-1 and the roller 32-2-2 is pressed against the roller 31.

Figure 4C:
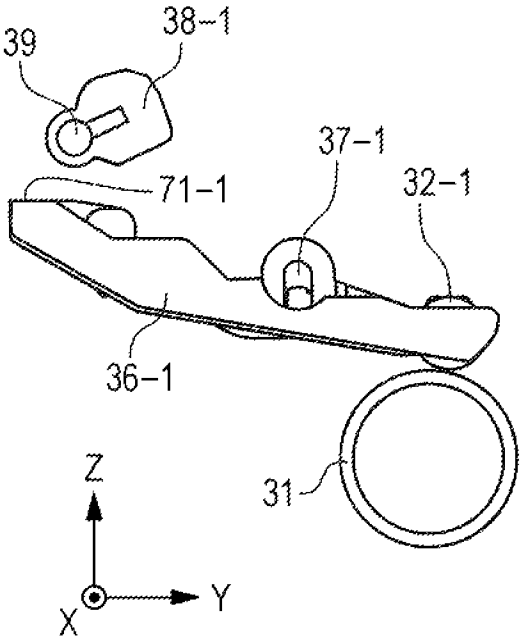

As illustrated in FIG. 4C, the outer periphery of the cam 38-1 leaves apart from the contact surface 71-1 provided in the support member 36-1. In this case, since the back side of the support member 36-1, that is, the back side of a portion in which the shaft support section 37-1 is provided is pulled up by the coil spring 50, the downward force is applied to the end section of the front side of the support member 36-1. The support member 36-1 is oscillated around the shaft support section 37-1 in the clockwise direction in FIG. 4C. Since the end section of the front side of the support member 36-1 moves to the lower side, the roller 32-1 is pressed against the roller 31.

As described above, when the paper of A3 is transported and recorded, the posture of the support member 36-1 is switched to the posture in which the roller 32-1 is urged to the side of the roller 31, the posture of the support member 36-2-1 is switched to the posture in which the roller 32-2-1 is urged to the side of the roller 31, the posture of the support member 36-2-2 is switched to the posture in which the roller 32-2-2 is urged to the side of the roller 31, the posture of the support member 36-3-1 is switched to the posture in which the roller 32-3-1 is urged to the side of the roller 31, and the posture of the support member 36-3-2 is switched to the posture in which the roller 32-3-2 is urged to the side of the roller 31.

Next, when the paper of A4 or A5 is transported and recorded, the support member 36-1, the support member 36-2-1, the support member 36-2-2, the support member 36-3-1 and the support member 36-3-2, and cam 38-1, the cam 38-2-1, the cam 38-2-2, the cam 38-3-1 or the cam 38-3-2 are described with reference to FIGS. 5 and 6A to 6C.

Figure 5:
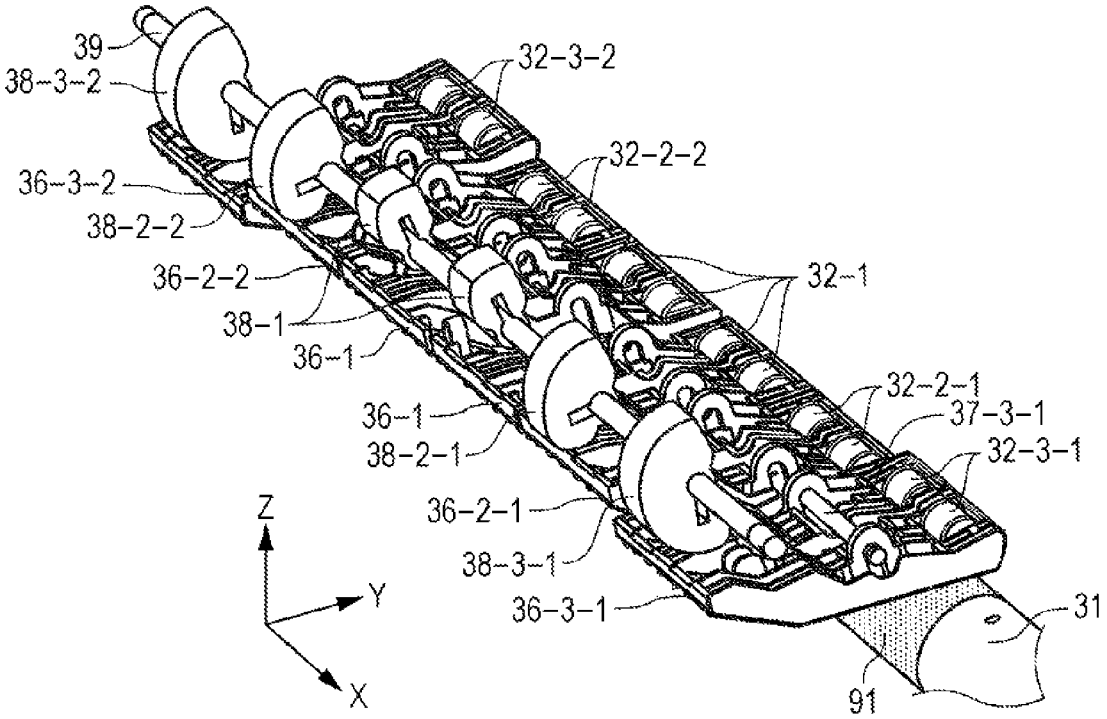
FIG. 5 is a perspective view of the support members and the cams.
Figure 6A:
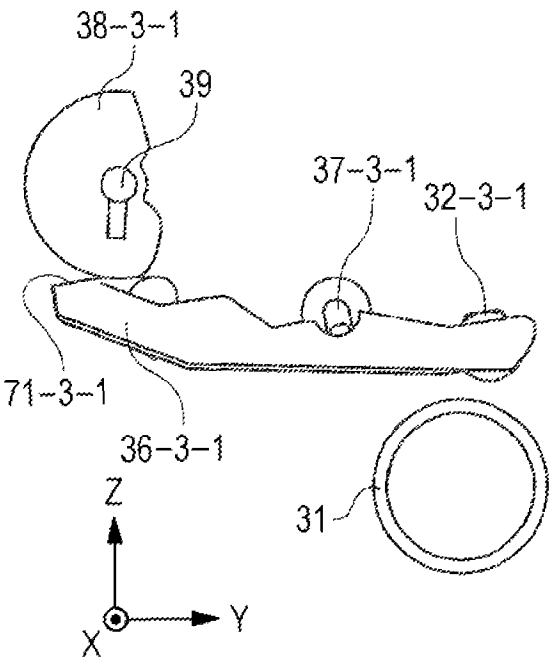
FIGS. 6A to 6C are side views of the support members and the cams.
Figure 6B:
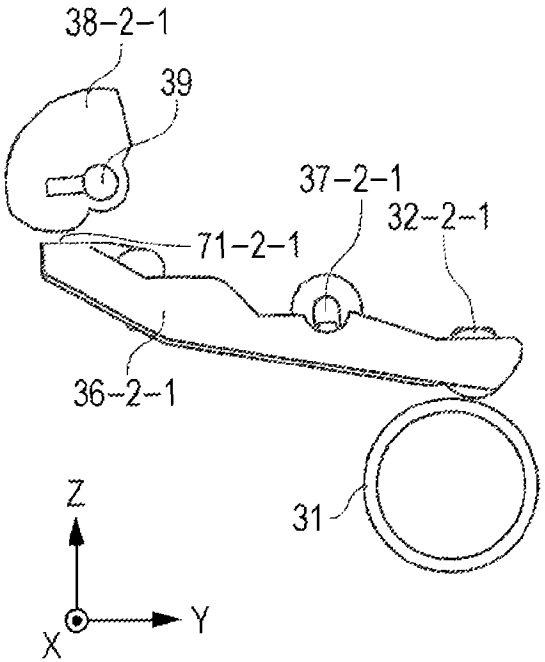
Figure 6C:
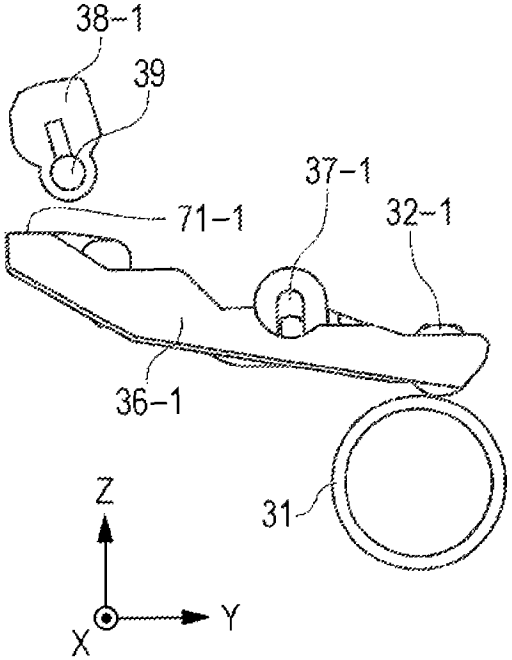

When the paper of A4 or A5 is transported and recorded, the control section 51 controls the motor 52 and rotates the rotation shaft 39. Then, as illustrated in FIG. 5, the angular positions of the cam 38-1, the cam 38-2-1, the cam 38-2-2, the cam 38-3-1 and the cam 38-3-2 provided in the rotation shaft 39 are predetermined angular positions of a case where the paper of A4 or A5 is transported and recorded. As illustrated in FIGS. 6A to 6C, when the paper of A4 or A5 is transported and recorded, the angular positions of the cam 38-1, the cam 38-2-1, the cam 38-2-2, the cam 38-3-1 and the cam 38-3-2 are angular positions which are rotated 90° in the counter-clockwise direction from the angular positions in a case where the paper of A3 is transported and recorded as illustrated in FIGS. 4A to 4C.

As illustrated in FIG. 6A, the outer periphery of the cam 38-3-1 pushes down the contact surface 71-3-1 provided in the support member 36-3-1. As a result, the support member 36-3-1 is oscillated around the shaft support section 37-3-1 in the counter-clockwise direction in FIG. 6A. Since the end section of the front side of the support member 36-3-1 moves to the upper side, the roller 32-3-1 leaves apart from the roller 31.

In this case, the support member 36-3-2 is operated similar to the support member 36-3-1 and the roller 32-3-2 is left apart from the roller 31.

As illustrated in FIG. 6B, the outer periphery of the cam 38-2-1 leaves apart from the contact surface 71-2-1 provided in the support member 36-2-1. In this case, since the back side of the support member 36-2-1, that is, the back side of a portion in which the shaft support section 37-2-1 is provided is pulled up by the coil spring 50, the downward force is applied to the end section of the front side of the support member 36-2-1. The support member 36-2-1 is oscillated around the shaft support section 37-2-1 in the clockwise direction in FIG. 6B. Since the end section of the front side of the support member 36-2-1 moves to the lower side, the roller 32-2-1 is pressed against the roller 31.

In this case, the support member 36-2-2 is operated similar to the support member 36-2-1 and the roller 32-2-2 is pressed against the roller 31.

As illustrated in FIG. 6C, the outer periphery of the cam 38-1 leaves apart from the contact surface 71-1 provided in the support member 36-1. In this case, since the back side of the support member 36-1, that is, the back side of a portion in which the shaft support section 37-1 is provided is pulled up by the coil spring 50, the downward force is applied to the end section of the front side of the support member 36-1. The support member 36-1 is oscillated around the shaft support section 37-1 in the clockwise direction in FIG. 6C. Since the end section of the front side of the support member 36-1 moves to the lower side, the roller 32-1 is pressed against the roller 31.

As described above, when the paper of A4 or A5 is transported and recorded, the posture of the support member 36-1 is switched to the posture in which the roller 32-1 is urged to the side of the roller 31, the posture of the support member 36-2-1 is switched to the posture in which the roller 32-2-1 is urged to the side of the roller 31, the posture of the support member 36-2-2 is switched to the posture in which the roller 32-2-2 is urged to the side of the roller 31, the posture of the support member 36-3-1 is switched to the posture in which the roller 32-3-1 is left apart from the roller 31, and the posture of the support member 36-3-2 is switched to the posture in which the roller 32-3-2 is left apart from the roller 31.

Next, when the paper as the postcard is transported and recorded, the support member 36-1, the support member 36-2-1, the support member 36-2-2, the support member 36-3-1 and the support member 36-3-2, and cam 38-1, the cam 38-2-1, the cam 38-2-2, the cam 38-3-1 or the cam 38-3-2 are described with reference to FIGS. 7 and 8A to 8C. When the paper as the postcard is transported and recorded, the control section 51 controls the motor 52 and rotates the rotation shaft 39.

Figure 7:
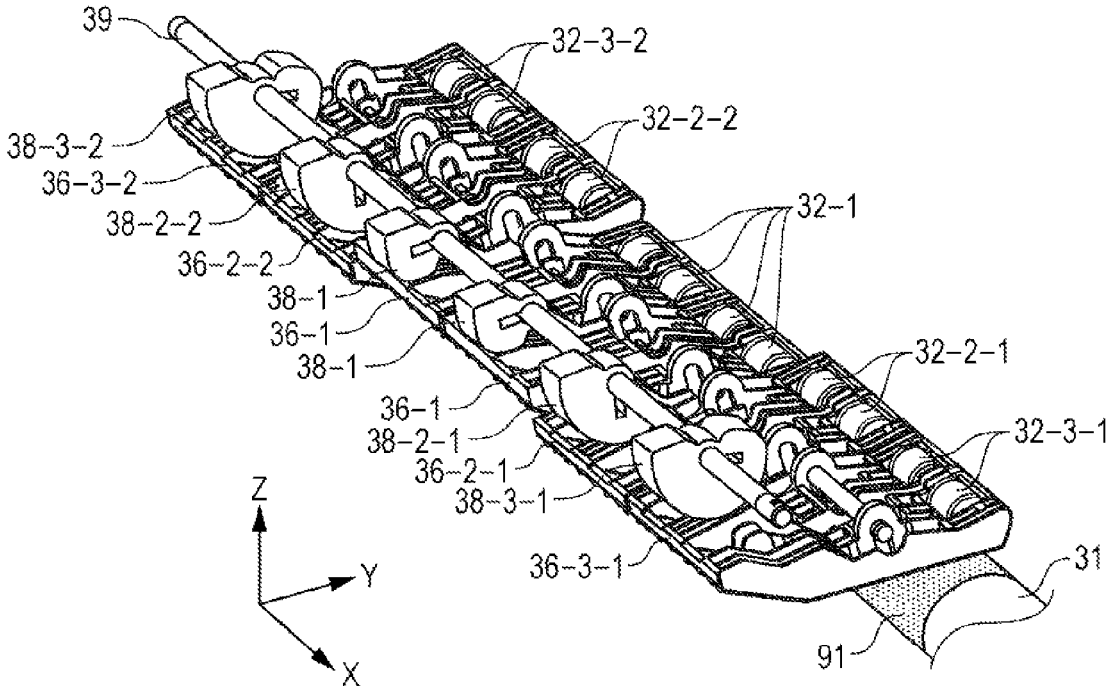
FIG. 7 is a perspective view of the support members and the cams.
Figure 8A:
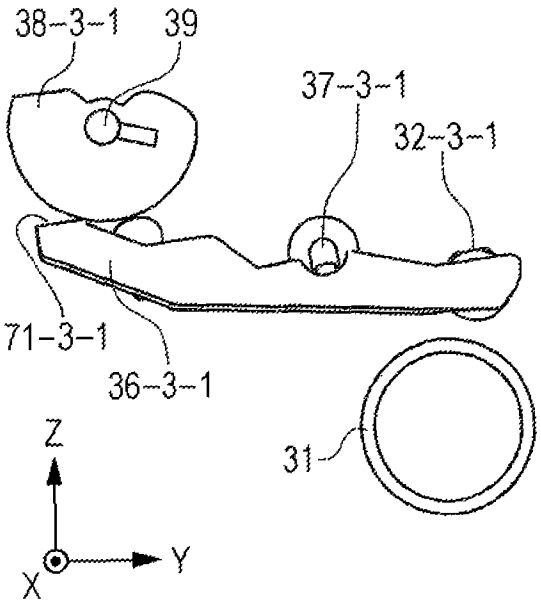
FIGS. 8A to 8C are side views of the support members and the cams.
Figure 8B:
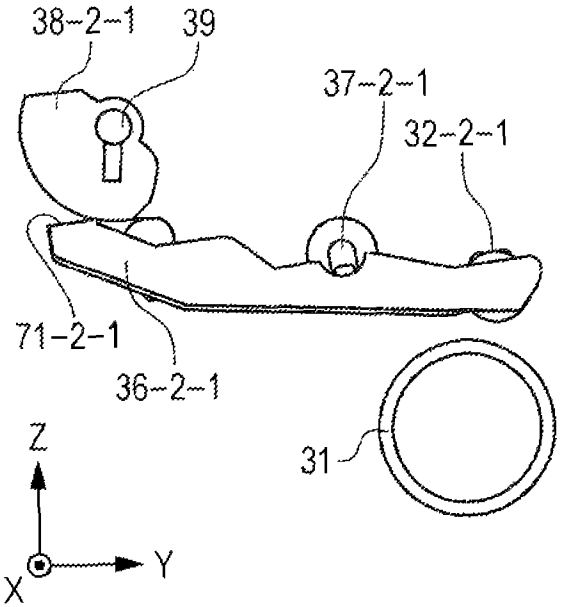
Figure 8C:
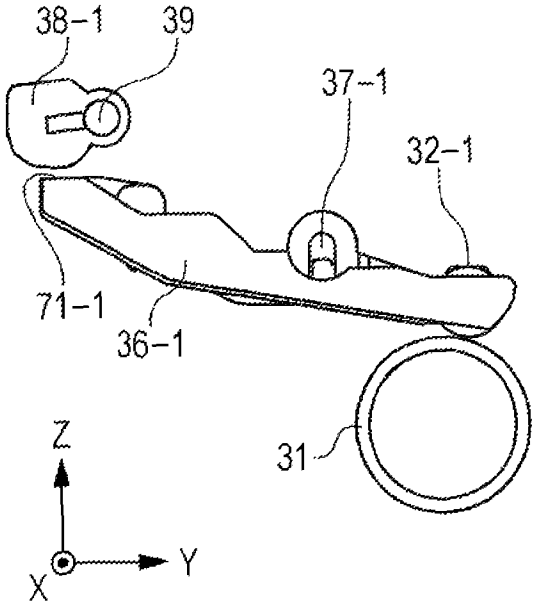

Then, as illustrated in FIG. 7, the angular positions of the cam 38-1, the cam 38-2-1, the cam 38-2-2, the cam 38-3-1 and the cam 38-3-2 provided in the rotation shaft 39 are predetermined angular positions of a case where the paper as the postcard is transported and recorded. As illustrated in FIGS. 8A to 8C, when the paper as the postcard is transported and recorded, the angular positions of the cam 38-1, the cam 38-2-1, the cam 38-2-2, the cam 38-3-1 and the cam 38-3-2 are the angular positions which are rotated 90° in the counter-clockwise direction from the angular positions in a case where the paper of A4 or A5 is transported and recorded as illustrated in FIGS. 6A to 6C.

As illustrated in FIG. 8A, the outer periphery of the cam 38-3-1 pushes down the contact surface 71-3-1 provided in the support member 36-3-1. As a result, the support member 36-3-1 is oscillated around the shaft support section 37-3-1 in the counter-clockwise direction in FIG. 8A. Since the end section of the front side of the support member 36-3-1 moves to the upper side, the roller 32-3-1 leaves apart from the roller 31.

In this case, the support member 36-3-2 is operated similar to the support member 36-3-1 and the roller 32-3-2 is left apart from the roller 31.

As illustrated in FIG. 8B, the outer periphery of the cam 38-2-1 pushes down the contact surface 71-2-1 provided in the support member 36-2-1. As a result, the support member 36-2-1 is oscillated around the shaft support section 37-2-1 in the counter-clockwise direction in FIG. 8B. Since the end section of the front side of the support member 36-2-1 moves to the upper side, the roller 32-2-1 leaves apart from the roller 31.

In this case, the support member 36-2-2 is operated similar to the support member 36-2-1 and the roller 32-2-2 is left apart from the roller 31.

As illustrated in FIG. 8C, the outer periphery of the cam 38-1 leaves apart from the contact surface 71-1 provided in the support member 36-1. In this case, since the back side of the support member 36-1, that is, the back side of a portion in which the shaft support section 37-1 is provided is pulled up by the coil spring 50, the downward force is applied to the end section of the front side of the support member 36-1. The support member 36-1 is oscillated around the shaft support section 37-1 in the clockwise direction in FIG. 8C. Since the end section of the front side of the support member 36-1 moves to the lower side, the roller 32-1 is pressed against the roller 31.

As described above, when the paper as the postcard is transported and recorded, the posture of the support member 36-1 is switched to the posture in which the roller 32-1 is urged to the side of the roller 31, the posture of the support member 36-2-1 is switched to the posture in which the roller 32-2-1 is left apart from the roller 31, the posture of the support member 36-2-2 is switched to the posture in which the roller 32-2-2 is left apart from the roller 31, the posture of the support member 36-3-1 is switched to the posture in which the roller 32-3-1 is left apart from the roller 31, and the posture of the support member 36-3-2 is switched to the posture in which the roller 32-3-2 is left apart from the roller 31.

Next, in a state where the leading end of the paper of the next page reaches between the roller 31 and the roller 32 after the trailing end of the paper of the preceding page is removed between the roller 31 and the roller 32 when recording is performed on the plurality of pages or a state where the recording is not performed, the support member 36-1, the support member 36-2-1, the support member 36-2-2, the support member 36-3-1 and the support member 36-3-2, and cam 38-1, the cam 38-2-1, the cam 38-2-2, the cam 38-3-1 or the cam 38-3-2 are described with reference to FIGS. 9 and 10A to 10C.

Figure 9:
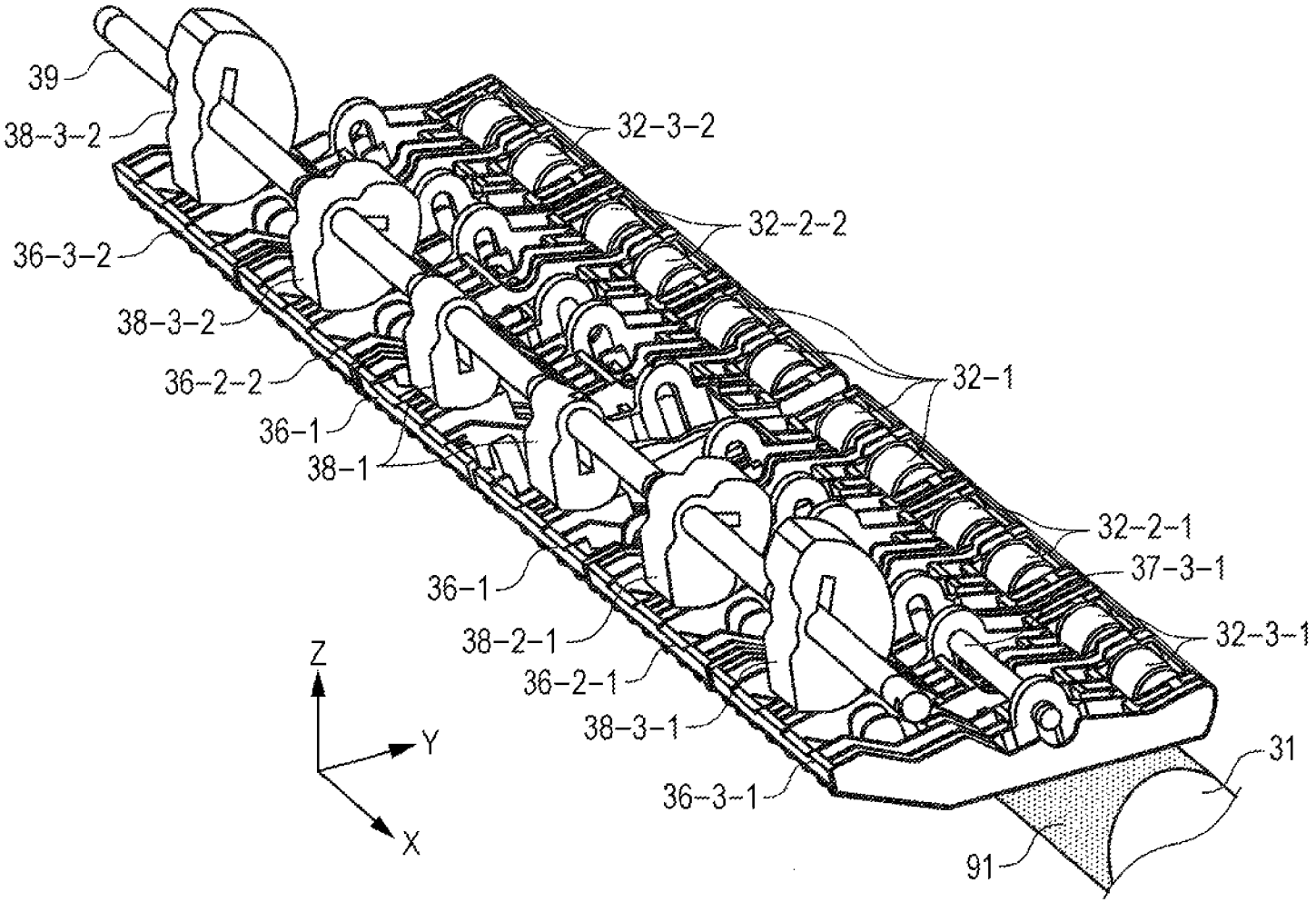
FIG. 9 is a perspective view of the support members and the cams.

The control section 51 controls the motor 52 and rotates the rotation shaft 39 in the state where the leading end of the paper of the next page reaches between the roller 31 and the roller 32 after the trailing end of the paper of the preceding page is removed between the roller 31 and the roller 32 when recording is performed on a plurality of pages or a state where the recording is not performed. Then, as illustrated in FIG. 9, the angular positions of cam 38-1, the cam 38-2-1, the cam 38-2-2, the cam 38-3-1 and the cam 38-3-2 provided in the rotation shaft 39 are predetermined angular positions of the state where the leading end of the paper of the next page reaches between the roller 31 and the roller 32 after the trailing end of the paper of the preceding page is removed between the roller 31 and the roller 32 when recording is performed on a plurality of pages or a state where the recording is not performed.

Figure 10A:
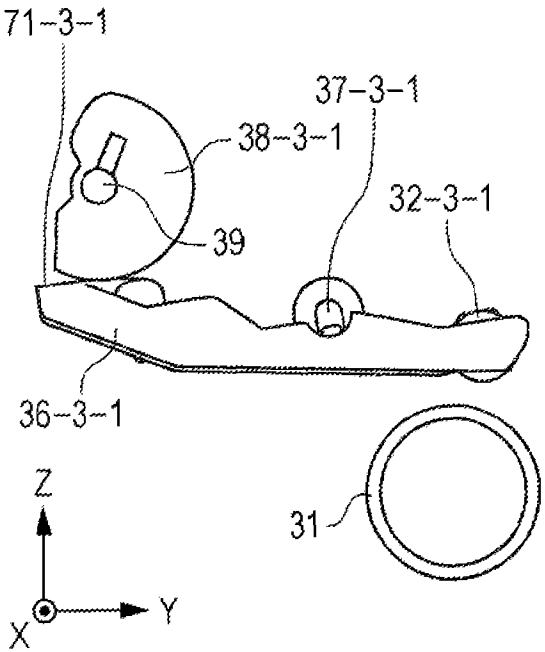
FIGS. 10A to 10C are side views of the support members and the cams.
Figure 10B:
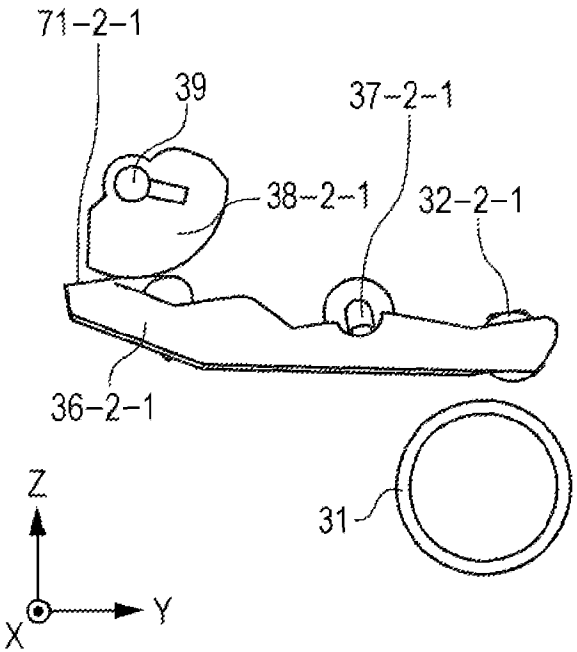
Figure 10C:
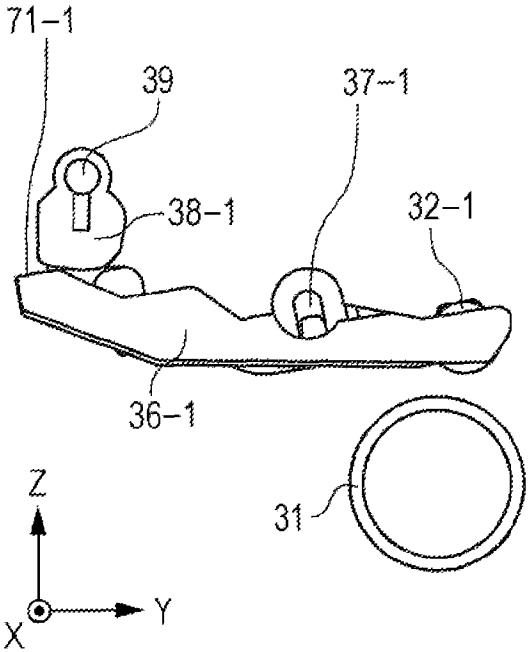

As illustrated in FIGS. 10A to 10C, the angular positions of cam 38-1, the cam 38-2-1, the cam 38-2-2, the cam 38-3-1 and the cam 38-3-2 in the state where the leading end of the paper of the next page reaches between the roller 31 and the roller 32 after the trailing end of the paper of the preceding page is removed between the roller 31 and the roller 32 when recording is performed on a plurality of pages or a state where the recording is not performed are the angular positions which are rotated 90° in the counter-clockwise direction from the angular positions in a case where the paper as the postcard is transported and recorded as illustrated in FIGS. 8A to 8C.

As illustrated in FIG. 10A, the outer periphery of the cam 38-3-1 pushes down the contact surface 71-3-1 provided in the support member 36-3-1. As a result, the support member 36-3-1 is oscillated around the shaft support section 37-3-1 in the counter-clockwise direction in FIG. 10A. Since the end section of the front side of the support member 36-3-1 moves to the upper side, the roller 32-3-1 leaves apart from the roller 31.

In this case, the support member 36-3-2 is operated similar to the support member 36-3-1 and the roller 32-3-2 is left apart from the roller 31.

As illustrated in FIG. 10B, the outer periphery of the cam 38-2-1 pushes down the contact surface 71-2-1 provided in the support member 36-2-1. As a result, the support member 36-2-1 is oscillated around the shaft support section 37-2-1 in the counter-clockwise direction in FIG. 10B. Since the end section of the front side of the support member 36-2-1 moves to the upper side, the roller 32-2-1 leaves apart from the roller 31.

In this case, the support member 36-2-2 is operated similar to the support member 36-2-1 and the roller 32-2-2 is left apart from the roller 31.

As illustrated in FIG. 10C, the outer periphery of the cam 38-1 pushes down the contact surface 71-1 provided in the support member 36-1. The support member 36-1 is oscillated around the shaft support section 37-1 in the counter-clockwise direction in FIG. 10C. Since the end section of the front side of the support member 36-1 moves to the upper side, the roller 32-1 is left apart from the roller 31.

As described above, in the state where the leading end of the paper of the next page reaches between the roller 31 and the roller 32 after the trailing end of the paper of the preceding page is removed between the roller 31 and the roller 32 when recording is performed on a plurality of pages or a state where the recording is not performed, the posture of the support member 36-1 is switched to the posture in which the roller 32-1 is left apart from the roller 31, the posture of the support member 36-2-1 is switched to the posture in which the roller 32-2-1 is left apart from the roller 31, the posture of the support member 36-2-2 is switched to the posture in which the roller 32-2-2 is left apart from the roller 31, the posture of the support member 36-3-1 is switched to the posture in which the roller 32-3-1 is left apart from the roller 31, and the posture of the support member 36-3-2 is switched to the posture in which the roller 32-3-2 is left apart from the roller 31.

Further, cam 38-1, the cam 38-2-1, the cam 38-2-2, the cam 38-3-1 and the cam 38-3-2 are different from each other in at least one of shapes and mounting forms to the rotation shaft 39. The support member 36-1, the support member 36-2-1, the support member 36-2-2, the support member 36-3-1 or the support member 36-3-2 takes a posture depending on the sizes of the plurality of papers in a range of one rotation of the rotation shaft 39.

The roller position switching section 61 causes the roller 32 located outside the region of the paper among the plurality of rollers 32 to leave apart from the roller 31.

The roller position switching section 61 causes the roller 32 associated with the region of the paper to leave apart from the roller 31 for at least a predetermined period until the leading end of the paper of the next page reaches between the roller 31 and the roller 32 after the trailing end of the paper of the preceding page is removed between the roller 31 and the roller 32 when the recording is performed on a plurality of pages. Further, the roller position switching section 61 causes all rollers 32 to leave apart from the roller 31 at least when the recording is not performed.

Moreover, the printer 11 is described as an example, but the invention is not limited to the embodiment and can be applied to a recording apparatus such as a facsimile machine, a copier or a combined machine.

As described above, the printer 11 that is an example of the recording apparatus includes the roller 31 that is an example of a first roller; the rollers 32 which are displaceably provided between the position coming into contact with the first roller and the position leaving apart from the first roller, and an example of a plurality of second rollers disposed along the axial direction of the rotation of the first roller; and the roller position switching section 61 that is an example of a unit that switches roller position that causes the second rollers located outside the region of the medium among the plurality of second rollers to leave apart from the first roller. The paper is an example of the medium. The size of A3, A4 or A5, or the postcard is an example of the size of the medium.

Since the printer 11 has the roller position switching section 61 that causes the rollers 32 located outside the region of the paper among the plurality of rollers 32 to leave apart from the roller 31, it is possible to suppress occurrence of noise caused by the roller 32 coming into contact with the roller 31 and obtain the printer 11 with reduced noise.

In addition, it is possible to prevent wear of the roller 32 and the roller 31, and to improve durability of the apparatus by the roller 32 located outside the region of the paper leaving apart from the roller 31.

The plurality of support members 36 are provided along the axial direction of the rotation of the first roller and are an example of a support member including at least one driven roller that switches the posture that causes the second roller to come into contact with the first roller and the posture that causes the second roller to leave apart from the first roller by oscillating. The cams 38 which are provided in the plurality of support members, individually and which are an example of a rotatable cam member engaging the support member in the position away from the oscillation center of the support member; and the motor 52 that is an example of a cam driving source rotating the cam member are provided in the roller position switching section 61 that is an example of the unit that switches roller position. The motor 52 that is an example of the cam driving source rotates the cam 38 that is an example of a cam member. Therefore, it is possible for the support member 36 that is an example of the support member to switch the posture.

Since the roller 32 comes into contact with and leaves apart from the roller 31 by the rotation of the cam 38, it is possible to configure the roller position switching section 61 with a simple structure and at a low cost.

The cams 38 that are an example of a plurality of cam members are provided in the rotation shaft 39 that is an example of one rotation shaft that is rotated by the cam driving source. The cams 38 that are an example of the plurality of cam members are different from each other in at least one of the shapes and mounting forms with respect to one rotation shaft. Therefore, it is possible for the support member 36 that is an example of the support member to take the posture depending on the size of the paper that is an example of a plurality of media in the range of one rotation of the rotation shaft 39 that is an example of one rotation shaft.

In this case, since each of the plurality of support members 36 takes the posture depending on the sizes of the plurality of papers by rotating one rotation shaft 39, it is possible to obtain the configuration of the support member 36 taking the posture depending on the sizes of the plurality of papers easily and at a low cost.

Further, it is possible for the roller position switching section 61 that is an example of the unit that switches roller position to cause the roller 32 that is an example of the second roller associated with the region of the medium to leave apart from the roller 31 that is an example of the first roller, for at least a predetermined period until the leading end of the medium of the next page reaches between the roller 31 that is an example of the first roller and the roller 32 that is an example of the second roller after the trailing end of the medium of the preceding page is removed between the roller 31 that is an example of the first roller and the roller 32 that is an example of the second roller, when the recording is performed on the plurality of pages.

Since the roller position switching section 61 also causes the roller 32 associated with the region of the paper to leave apart from the roller 31 in at least a predetermined period while it does not contribute to the transportation of the paper during recording, it is possible to reliably prevent occurrence of the noise caused by the rollers 32 coming into contact with the roller 31.

It is possible for the roller position switching section 61 that is an example of the unit that switches roller position to cause all the rollers 32 which are an example of the second roller to leave apart from the roller 31 that is an example of the first roller at least when the recording is not performed.

Since the roller position switching section 61 causes all the rollers 32 to leave apart from the roller 31 at least when the recording is not performed, it is possible to more reliably prevent occurrence of the noise caused by the roller 32 coming into contact with the roller 31.

Here, the time period of when the recording is not performed includes a time zone while the leading end of the paper of at least first page reaches between the roller 31 and the roller 32 or after the trailing end of the paper of the last page is removed between the roller 31 and the roller 32 even during performing a print job, or during not performing the print job.

Next, in the embodiment, since the roller 31 that is an example of the first roller is formed by attaching particles on the outer peripheral surface of the metal shaft, the noise described above is likely to occur by the roller 32 coming into contact with the roller 31, but it is possible to suppress the occurrence of the noise by the operation described above.

It is possible to form the roller 32 that is an example of the second roller with a resin material. Since the roller 32 is formed of the resin material, it is possible to form the outer peripheral surface of the roller 32 with a predetermined hardness and smoothly. Therefore, when performing skew operation for correcting skew of the paper, the leading end of the paper easily follows between the roller 31 and the roller 32, and it is possible to reliably perform the skew operation.

The plurality of rollers 32 which are an example of the second roller can be disposed in positions coming into contact with the both ends in the width direction intersecting the transportation direction with respect to the plurality of sizes of all media. Since the plurality of rollers 32 are disposed in positions coming into contact with the both ends in the width direction intersecting the transportation direction with respect to the plurality of sizes of all papers, it is possible to obtain a good recording result by preventing lifting of the end section of the paper regardless of the size of the paper.

Further, the invention is not limited to the embodiments and various modifications are possible within the scope of the invention described in the claims, and it goes without saying that they are also intended to be included in the scope of the invention.

What is claimed is:

1. A recording apparatus comprising:

a first roller;

a plurality of second rollers which are displaceably provided between a position that is urged to a side of the first roller and a position that is left apart from the first roller, and are disposed along an axial direction of rotation of the first roller; and a unit that switches roller position, which causes the second rollers located outside a region of a medium among the plurality of second rollers to leave apart from the first roller, wherein the unit that switches roller position causes the second rollers located outside the region of the medium among the plurality of second rollers to leave apart from the first roller depending on a width of the medium that is transported.

2. The recording apparatus according to claim 1, wherein the unit that switches roller position causes the second rollers associated with the region of the medium to leave apart from the first roller for at least a predetermined period until a leading end of the medium of the next page reaches between the first roller and the second rollers after a trailing end of the medium of the preceding page is removed between the first roller and the second rollers when recording is performed on a plurality of pages.

3. The recording apparatus according to claim 1, further comprising:

a plurality of support members which are provided along the axial direction of the rotation of the first roller and includes at least one driven roller that switches a posture which causes the second rollers to urge to the side of the first roller and a posture which causes the second rollers to leave apart from the first roller by oscillating, wherein the unit that switches roller position includes rotatable cam members which are provided with respect to the plurality of support members, individually and engage the support members in positions away from an oscillation center of the support members, and a cam driving source that rotates the cam members, and wherein the cam driving source rotates the cam member so that the support members perform the switching of the posture.

4. The recording apparatus according to claim 3, wherein a plurality of cam members are provided in one rotation shaft that is driven to rotate by the cam driving source, wherein at least one of shapes and mounting forms of the plurality of cam members with respect to the one rotation shaft is different from each other, and wherein the support members take a posture depending on sizes of a plurality of media in a range of one rotation of the one rotation shaft.

5. The recording apparatus according to claim 1, wherein the unit that switches roller position causes all of the second rollers to leave apart from the first roller at least when the recording is not performed.

6. The recording apparatus according to claim 1, wherein the first roller is formed by attaching particles on an outer peripheral surface of a metal shaft.

* * * * *